US006761854B1

(12) United States Patent
Smith et al.

(10) Patent No.: US 6,761,854 B1
(45) **Date of Patent: *Jul. 13, 2004**

(54) ADVANCED HIGH TEMPERATURE CORROSION RESISTANT ALLOY

(75) Inventors: Gaylord Darrell Smith, Huntington, VA (US); Curtis Steven Tassen, Huntington, VA (US)

(73) Assignee: Huntington Alloys Corporation, Huntington, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/148,749

(22) Filed: Sep. 4, 1998

(51) Int. Cl.[7] ..... C22C 19/05
(52) U.S. Cl. ..... 420/443; 420/441
(58) Field of Search ..... 420/441, 443, 420/455, 460, 458

(56) References Cited

U.S. PATENT DOCUMENTS

| | | | | | |
|---|---|---|---|---|---|
| 2,712,498 | A | | 7/1955 | Gresham et al. | 75/171 |
| 3,015,558 | A | | 1/1962 | Grant et al. | 75/171 |
| 3,151,981 | A | | 10/1964 | Smith et al. | 75/171 |
| 3,479,157 | A | | 11/1969 | Richards et al. | 29/194 |
| 3,681,059 | A | | 8/1972 | Shaw et al. | 75/134 |
| 3,723,107 | A | | 3/1973 | Richards et al. | 75/171 |
| 3,723,108 | A | | 3/1973 | Twigg et al. | 75/171 |
| 3,859,060 | A | | 1/1975 | Einstein et al. | 29/193 |
| 4,039,330 | A | | 8/1977 | Shaw | 75/171 |
| 4,474,733 | A | | 10/1984 | Susukida et al. | 420/443 |
| 4,727,740 | A | | 3/1988 | Yabuki et al. | 72/209 |
| 4,764,225 | A | * | 8/1988 | Shankar et al. | 148/404 |
| 4,810,467 | A | | 3/1989 | Wood et al. | 420/448 |
| 4,981,644 | A | | 1/1991 | Chang | 420/442 |
| 5,370,497 | A | | 12/1994 | Doi et al. | 415/199.5 |
| 5,372,662 | A | | 12/1994 | Ganesan et al. | 148/428 |
| 5,556,594 | A | | 9/1996 | Frank et al. | 420/448 |
| 5,780,116 | A | * | 7/1998 | Sileo et al. | 427/456 |
| 5,900,078 | A | | 5/1999 | Yakuwa et al. | 148/410 |
| 5,939,204 | A | * | 8/1999 | Czech | 428/469 |
| 6,258,317 | B1 | * | 7/2001 | Smith et al. | 420/448 |

FOREIGN PATENT DOCUMENTS

| | | |
|---|---|---|
| EP | 0260600 | 3/1988 |
| EP | 0790324 | 8/1997 |
| GB | 880805 | 10/1961 |
| JP | 61-147838 | 7/1986 |
| WO | WO9967436 | 12/1999 |

* cited by examiner

*Primary Examiner*—Sikyin Ip
(74) *Attorney, Agent, or Firm*—Bond, Schoeneck & King, PLLC

(57) ABSTRACT

A nickel-base alloy consisting of, in weight percent, 42 to 58 nickel, 21 to 28 chromium, 12 to 18 cobalt, 4 to 9.5 molybdenum, 2 to 3.5 aluminum, 0.05 to 2 titanium, at least one microalloying agent selected from the group consisting of 0.005 to 0.1 yttrium and 0.01 to 0.6 zirconium, 0.01 to 0.15 carbon, 0 to 0.01 boron, 0 to 4 iron, 0 to 1 manganese, 0 to 1 silicon, 0 to 1 hafnium, 0 to 0.4 niobium, 0 to 0.1 nitrogen, incidental impurities and deoxidizers.

14 Claims, No Drawings

ADVANCED HIGH TEMPERATURE CORROSION RESISTANT ALLOY

FIELD OF THE INVENTION

This invention relates to the field of nickel-base alloys possessing resistance to high temperature corrosive environments.

BACKGROUND OF THE INVENTION

Nickel-base high temperature alloys serve in numerous applications, such as, regenerators, recuperators, combustors and other gas turbine components, muffles and furnace internals, retorts and other chemical process equipment and transfer piping, boiler tubing, piping and waterwall aprons and waste incineration hardware. Alloys for these applications must possess outstanding corrosion resistance to meet the long life requirements becoming critical in new facility design and operation. While virtually all major industrial equipment is exposed to air on one surface or at one part of the unit, the internal surfaces can be exposed to very aggressive carburizing, oxidizing, sulfidizing, nitriding, or combinations of these corrodents. Consequently, maximum corrosion resistance to the broadest possible range of aggressive high temperature environments, is a long-sought aim of the metallurgical industry.

Traditionally, these alloys rely on precipitation hardening from a combination of γ' [$Ni_3$(Al, Ti)], γ" [$Ni_3$(Nb, Al, Ti)], carbide precipitation and solid solution strengthening to give the alloy strength. The γ' and γ" phases precipitate as stable intermetallics that are essentially coherent with the austenitic-fcc matrix. This combination of precipitates significantly enhances the high temperature mechanical properties of the alloy.

It is an object of this invention to provide an alloy that possesses resistance to carburizing, oxidizing, nitriding and sulfidizing environments.

It is a further object of this invention to provide an alloy with sufficient phase stability and mechanical integrity for demanding, high temperature applications.

SUMMARY OF THE INVENTION

A nickel-base alloy consisting of, in weight percent, 42 to 58 nickel, 21 to 28 chromium, 12 to 18 cobalt, 4 to 9.5 molybdenum, 2 to 3.5 aluminum, 0.05 to 2 titanium, at least one microalloying agent selected from the group consisting of 0.005 to 0.1 yttrium for carburization resistance and 0.01 to 0.6 zirconium for sulfidation resistance, 0.01 to 0.15 carbon, 0 to 0.01 boron, 0 to 4 iron, 0 to 1 manganese, 0 to 1 silicon, 0 to 1 hafnium, 0 to 0.4 niobium, 0 to 0.1 nitrogen, incidental impurities and deoxidizers.

DESCRIPTION OF PREFERRED EMBODIMENT

A high temperature, high strength alloy characterized, in part, by a unique combination of microalloying elements to achieve extremely high levels of corrosion resistance in a broad spectrum of aggressive environments. A nickel base of 42 to 58 weight percent provides an austenitic matrix for the alloy. (This specification expresses all alloy compositions in weight percent.) An addition of 12 to 18 weight percent cobalt enhances the corrosion resistance of the alloy and contributes solid solution strengthening to the matrix. This matrix has sufficient corrosion resistance to tolerate up to 4 weight percent iron, up to 1 weight percent manganese and up to 1 weight percent silicon without a substantial decrease in corrosion resistance. Allowing iron, manganese and silicon into the alloy facilitates the recycling of nickel-base alloys. Furthermore, manganese may benefit the alloy by tying up trace amounts of sulfur. In addition, the alloy may contain incidental impurities such as oxygen, sulfur, phosphorus and deoxidizers such as calcium, magnesium and cerium.

An addition of 21 to 28 weight percent chromium imparts oxidation resistance to the alloy. Chromium levels less than 21 weight percent are inadequate for oxidation resistance; levels above 28 weight percent can produce detrimental chromium-containing precipitates. An addition of 4 to 10 weight percent molybdenum contributes to stress corrosion cracking resistance and contributes some solid solution strengthening to the matrix. Aluminum in an amount ranging from 2 to 3.5 weight percent contributes to oxidation resistance and can precipitate as γ' phase to strengthen the matrix at intermediate temperatures. Most advantageously, the matrix should contain at least 2.75 weight percent aluminum for excellent oxidation resistance.

For sulfidation resistance, it is critical that the alloy contain a minimum of 0.01 weight percent zirconium to stabilize the scale against inward migration of sulfur through its protective scale layer. Zirconium additions above 0.6 weight percent adversely impact the alloy's fabricability. Advantageously, an addition of at least 0.005 weight percent yttrium improves both oxidation and nitridation resistance of the alloy and is critical to establish carburization resistance. Yttrium levels above 0.1 increase the cost and decrease the hot workability of the alloy. Only when optimum levels of chromium, aluminum and critical microalloying levels of yttrium and zirconium are present in the alloy will outstanding corrosion resistance be achieved in the complete spectrum of carburizing, oxidizing, nitriding and sulfidizing environments. However, where only carburizing and oxidizing corrosion resistance is required, the microalloying with zirconium can be omitted from the composition. Where only sulfidizing and oxidizing corrosion resistance is required, yttrium can be omitted from the composition. Maximum overall corrosion resistance is achieved by a combination containing at least 2.75 weight percent aluminum, 0.01 weight percent zirconium and 0.01 weight percent yttrium.

The optional elements of 0 to 1 weight percent hafnium and 0 to 0.1 weight percent nitrogen stabilize the oxide scale to contribute toward oxidation resistance. Hafnium in the amount of at least 0.01 weight percent and nitrogen in the amount of at least 0.01 weight percent each serve to increase oxidation resistance. Excess hafnium or nitrogen levels deteriorate the mechanical properties of the alloy.

An addition of 0.05 to 2 weight percent titanium will act like the aluminum addition and contributes to the alloy's high temperature mechanical properties by precipitating as γ' phase. Most advantageously, γ' phase consists of 8 to 20 weight percent of the alloy. Maintaining niobium at less than 0.4 percent enhances the alloy's stability by limiting the amount of metastable γ" precipitated. Most advantageously, γ" consists of less than 2 weight percent of the alloy. An addition of at least 0.01 percent carbon strengthens the matrix. But carbon levels above 0.15 weight percent can precipitate detrimental carbides. Optionally, a boron addition of at least 0.0001 weight percent boron enhances the hot workability of the alloy. Boron additions above 0.01 weight percent form excess precipitates at the grain boundaries.

A combination of cobalt, molybdenum and chromium with microalloying additions of titanium and zirconium achieve the unexpected corrosion resistance for multiple environments. The overall compositional range is defined as "about" the following ranges:

TABLE 1

| Element | Broad Range[1] | Intermediate Range[1] | Narrow Range[1] | Nominal Range |
|---|---|---|---|---|
| Al | 2–3.5 | 2.25–3.5 | 2.5–3.5 | 2.75–3.5 |
| B | 0–0.01 | 0.0001–0.01 | 0.001–0.009 | 0.003–0.008 |
| C | 0.01–0.15 | 0.01–0.14 | 0.01–0.12 | 0.02–0.1 |
| Co | 12–18 | 12.5–17.5 | 13–17 | 14–16 |
| Cr | 21–28 | 21.5–27 | 22–27 | 22–26 |
| Fe | 0–4 | 0–3 | 0.1–2.5 | 0.5–2 |
| Hf | 0–1 | 0–0.8 | 0–0.7 | 0–0.5 |
| Mn | 0–1 | 0–0.8 | 0–0.6 | 0–0.4 |
| Mo | 4–9.5 | 4.5–9 | 5–8.5 | 5–8 |
| N | 0–0.1 | 0.00001–0.08 | 0.0001–0.05 | 0.01–0.05 |
| Nb | 0–0.4 | 0–0.3 | 0–0.25 | 0–0.2 |
| Ni | 42–58 | 43–57 | 44–56 | 45–55 |
| Si | 0–1 | 0.01–0.7 | 0.02–0.5 | 0.05–0.4 |
| Ti | 0.05–2 | 0.06–1.6 | 0.08–1.2 | 0.1–1 |
| Y | 0.005–0.1 | 0.01–0.08 | 0.01–0.07 | 0.01–0.06 |
| Zr | 0.01–0.6 | 0.01–0.5 | 0.02–0.5 | 0.02–0.4 |

[1]Contains at least one of yttrium for carburization resistance or zirconium for sulfidation resistance.

Alloys 1 to 9 of Table 2 represent heats of the invention; Alloys A to D represent comparative heats.

TABLE 2

(WEIGHT PERCENT)

| Alloy | C | Mn | Fe | Si | Ni | Cr | Nb | Al | Ti | Co | Mo | Zr | Other |
|---|---|---|---|---|---|---|---|---|---|---|---|---|---|
| 1 | 0.08 | <.01 | 1.08 | 0.12 | 49.86 | 24.13 | 0.016 | 3.04 | 0.32 | 15.05 | 6.14 | 0.018 | B 0.007 |
| 2 | 0.08 | <0.01 | 1.07 | 0.12 | 49.33 | 23.94 | 0.020 | 3.07 | 0.32 | 14.94 | 6.10 | 0.042 | B 0.004 |
| | | | | | | | | | | | | | Y 0.019 |
| | | | | | | | | | | | | | Hf 0.42 |
| 3 | 0.034 | 0.008 | 1.06 | 0.16 | 49.58 | 24.10 | 0.023 | 3.34 | 0.28 | 15.04 | 6.11 | 0.012 | B 0.0004 |
| | | | | | | | | | | | | | Y 0.030 |
| 4 | 0.08 | <.01 | 1.07 | 0.12 | 49.72 | 24.06 | 0.017 | 3.08 | 0.30 | 15.06 | 6.14 | 0.21 | B 0.005 |
| | | | | | | | | | | | | | N 0.03 |
| 5 | 0.08 | <.01 | 1.08 | 0.12 | 49.71 | 24.06 | 0.021 | 3.03 | 0.36 | 15.05 | 6.18 | 0.21 | B 0.004 |
| | | | | | | | | | | | | | Y 0.032 |
| | | | | | | | | | | | | | N 0.032 |
| 6 | 0.08 | <.01 | 1.23 | 0.10 | 51.07 | 22.33 | 0.036 | 3.02 | 0.36 | 15.28 | 6.31 | 0.02 | Y 0.017 |
| 7 | 0.08 | <.01 | 1.02 | 0.12 | 49.66 | 24.14 | 0.029 | 3.07 | 0.34 | 15.06 | 6.19 | 0.21 | B 0.005 |
| | | | | | | | | | | | | | N 0.025 |
| 8 | 0.036 | 0.008 | 1.08 | 0.17 | 49.43 | 24.10 | 0.017 | 3.36 | 0.31 | 15.03 | 6.08 | 0.01 | B 0.0006 |
| | | | | | | | | | | | | | Y 0.049 |
| 9 | 0.09 | <0.01 | 1.15 | 0.11 | 49.67 | 24.03 | 0.023 | 3.05 | 0.34 | 15.01 | 6.22 | 0.033 | B 0.0037 |
| | | | | | | | | | | | | | Y 0.018 |
| | | | | | | | | | | | | | Hf 0.09 |
| 10 | 0.08 | <.01 | 1.10 | 0.12 | 49.92 | 24.12 | 0.022 | 3.03 | 0.33 | 15.00 | 6.13 | | B 0.005 |
| | | | | | | | | | | | | | Y 0.24 |
| 11 | 0.08 | <.01 | 0.08 | 0.12 | 50.91 | 24.09 | 0.024 | 3.05 | 0.31 | 15.04 | 6.13 | | B 0.004 |
| | | | | | | | | | | | | | Y 0.016 |
| 12 | 0.09 | <.01 | 1.09 | 0.12 | 49.93 | 24.08 | 0.020 | 3.04 | 0.32 | 15.05 | 6.14 | | Y 0.036 |
| 13 | 0.05 | 0.01 | 1.06 | 0.10 | 49.36 | 24.04 | 0.019 | 2.40 | 0.30 | 15.12 | 6.16 | | Y 0.027 |
| A | 0.05 | 0.01 | 1.16 | 0.15 | 52.40 | 24.02 | 0.001 | 0.88 | 0.32 | 14.92 | 6.08 | — | — |
| B | 0.06 | 0.01 | 1.06 | 0.14 | 51.51 | 24.01 | 0.001 | 1.06 | 0.33 | 15.14 | 6.20 | — | — |
| C | 0.05 | 0.01 | 1.06 | 0.13 | 50.05 | 24.06 | 0.001 | 3.02 | 0.32 | 15.10 | 6.18 | — | — |
| D | 0.035 | 0.007 | 1.04 | 0.13 | 49.33 | 24.16 | 0.006 | 3.12 | 0.34 | 15.06 | 6.12 | | B 0.006 |

Mechanical Properties

Components constructed from the alloy possess the strength necessary for mechanical integrity and the required stability necessary to retain structural integrity for high temperature corrosion applications. Alloy 13 is typical of the alloy's strength properties. The composition was vacuum melted and cast as a 25 kilogram heat. Part of the beat was soaked at 1204° C. and hot worked to 7.6 mm×127 mm×length slab with intermediate anneals at 1177° C./20 minutes/air cooled and then cold rolled to 0.158 mm×127 mm×length. A second portion of the heat was hot bar rolled from a 1204° C. furnace preheat to 22.2 mm diameter bar with a final anneal at 1177° C./20 minutes/air cooled. Table 3 presents the tensile properties of alloy 13 for selected temperatures to 982° C. Stress rupture strength data for the screening test condition of 982° C./41.4 MPa are given in Table 4. The effect of aging at 760° C./100 hours on room temperature tensile strength and Charpy impact strength are presented in Table 5.

TABLE 3

Tensile Properties as a Function of Temperature for Alloy 13

| Temperature (° C.) | 0.20%, Yield Strength (MPa) | Ultimate Tensile (MPa) | Elongation (%) |
|---|---|---|---|
| RT | 584 | 981 | 44.3 |
| 538 | 467 | 733 | 48.0 |
| 649 | 534 | 760 | 38.0 |
| 760 | 494 | 577 | 12.0 |
| 871 | 379 | 437 | 12.0 |
| 982 | 84.1 | 119 | 109.0 |

TABLE 4

Stress Rupture Strength Values for Selected Alloys (982° C./41.4 MPa)

| Alloy | Life (Hours) | Elongation (%) | Reduction in Area (%) |
|---|---|---|---|
| 1 | 10.2 | 60.0 | 47.0 |
| 4 | 12.3 | 43.1 | 38.0 |
| 6 | 20.1 | 62.6 | 58.7 |
| 7 | 20.1 | 62.6 | 58.7 |
| 11 | 10.4 | 43.7 | 36.3 |
| 12 | 14.7 | 44.6 | 45.8 |

TABLE 5

Effect of Aging on RT Tensile Properties of Selected Alloys 1177° C./1 Hour/Air Cool

| Alloy | ASTM Grain Size Number | 0.2% Yield Strength (MPa) | Ultimate Tensile (MPa) | Elongation (%) | Charpy Impact Strength (J) |
|---|---|---|---|---|---|
| 5 | 7 | 606 | 1072 | 31.4 | 80 |
| C | 2 | 528 | 894 | 52.9 | 228 |
| D | 2 | 565 | 939 | 49.3 | 278 |
| After Aging at 760° C./100 Hours/Air Cool | | | | | |
| 5 | 7 | 810 | 1239 | 21.4 | 45 |
| C | 2 | 669 | 1074 | 25.7 | 31 |
| D | 2 | 681 | 1089 | 30.7 | 29 |

Oxidation Resistance

High temperature alloys, a priori, must possess outstanding oxidation resistance. Retorts, muffles, piping and reactors, all too often, while internally containing a hot reactive process stream are exposed externally to air and, consequently, oxidation. Many process streams are oxidizing in nature as well, damaging the internals of gas turbines, boilers and power generation components. The oxidation resistance of the range of compositions of this patent application is exemplified by the oxidation data of Tables 6 and 7. The testing was done using 0.76 mm diameter×19.1 mm length pins in an electrically heated horizontal tube furnace using an air atmosphere plus 5 percent water vapor by weight. The specimens were cycled to RT at least weekly for weighing. The mass change (mg/cm$^2$) data versus time to 5,000 hours at 1100° C. are given in Table 6 and for times to 5,784 hours at 1200° C. in Table 7. Clearly aluminum contributes significantly to oxidation resistance in this range of compositions. Compare Alloys A and B with the compositions of this patent application at 1100° C. Note the progressive increase in oxidation resistance at 1200° C. with the increase in aluminum content and the further enhancement afforded by the microalloying in alloys 7 and 8. Scale integrity at 1100° C. has been enhanced as shown by the positive mass changes (no apparent loss of chromium by evaporation or spallation) by the additions 190 ppm yttrium, 420 ppm zirconium and 420 ppm hafnium of Alloy 2, by the additions of 320 ppm yttrium, 2100 ppm zirconium and 320 ppm nitrogen of Alloy 5 and by the addition of 270 ppm yttrium to alloy 13. This enhancement is maintained at 1200° C. as depicted in Table 7.

TABLE 6

Oxidation Resistance in Air Plus 5% Water Vapor at 1100° C. for Times to 5,000 Hours Mass Change (mg/cm$^2$) Time (Hours) - Cycled Weekly

| Alloy | 1,000 | 2,000 | 3,000 | 4,000 | 5,000 |
|---|---|---|---|---|---|
| 1 | −5.75 | −8.45 | −8.61 | −8.62 | −8.80 |
| 2 | 0.80 | 1.00 | 1.25 | 1.36 | 1.41 |
| 4 | −5.58 | −6.52 | −6.84 | −7.25 | −7.80 |
| 5 | 0.78 | 0.94 | 1.11 | 1.18 | 1.22 |
| 6 | −4.94 | −4.76 | −4.72 | −4.65 | −4.82 |
| 7 | −8.80 | −11.58 | −11.93 | −12.15 | −12.78 |
| 9 | −1.43 | −1.36 | −1.29 | −1.14 | −1.25 |
| 10 | −6.15 | −7.38 | −7.62 | −7.76 | −8.00 |
| 11 | −3.38 | −3.64 | −3.90 | −4.20 | −4.57 |
| 12 | −4.59 | −6.73 | −6.97 | −7.25 | −7.82 |
| 13 | 0.86 | 0.93 | 0.21 | 0.23 | 0.18 |
| A | −1.85 | −7.72 | −12.41 | −19.87 | −37.38 |
| B | −3.53 | −9.56 | −17.91 | −28.88 | −48.41 |
| C | 1.38 | 1.76 | −1.86 | −1.66 | −1.56 |

TABLE 7

Oxidation Resistance in Air Plus 5% Water Vapor at 1200° C. for Times to 5,784 Hours Mass Change (mg/cm$^2$)

| Time (Hours) | Alloy A | Alloy D | Alloy 3 | Alloy 8 |
|---|---|---|---|---|
| 168 | −4.05 | −9.82 | −0.58 | −0.60 |
| 480 | −11.97 | −10.27 | −0.61 | −0.38 |
| 816 | −21.97 | −10.30 | −0.32 | −0.20 |
| 1176 | −45.75 | −10.51 | −0.40 | −0.22 |
| 1872 | −269.48 | — | — | — |
| 3864 | — | −13.86 | 0.92 | −0.80 |
| 5784 | — | −39.66 | −2.29 | −1.59 |

Carburization Resistance

Carburization resistance is of paramount importance for certain high temperature equipment, such as, heat treating and sintering furnace muffles and internal hardware, selected chemical reactors and their process stream containment apparatus and power generation components. These atmospheres can range from purely carboneous (reducing) to highly oxidizing (as seen in gas turbine engines). Ideally, a corrosion resistant, high temperature alloy should be able to perform equally well under both reducing and oxidizing carburizing conditions. Alloys of the compositional range of this application possess excellent carburization resistance under both extremes of oxygen potential. These tests were conducted in electrically heated mullite tube furnaces in which the atmospheres were generated from bottled gases which were electronically metered through the capped furnace tubes. The atmospheres, prior to reacting with the test specimens, were passed over reformer catalysts (Girdler G56 or G90) to achieve equilibrium of the atmosphere. The flow of the atmospheres through the furnace was approximately 150 cc/minute.

TABLE 8

| Alloy | Carburization Resistance in Two Carburization Atmospheres at 1,000° C. for 1,008 Hours Mass Change (mg/cm$^2$) | |
|---|---|---|
| | $H_2$ - 1% $CH_4$ | $H_2$ - 5.5% $CH_4$ 45% $CO_2$ |
| 1 | 0.38 | 11.87 |
| 2 | 0.78 | 10.32 |
| 4 | 0.55 | 4.14 |
| 6 | 0.26 | 10.60 |
| 7 | 0.58 | 15.52 |
| 9 | 0.41 | 13.13 |
| 10 | 1.11 | 12.06 |
| 11 | 1.94 | 10.29 |
| 12 | 2.06 | 15.35 |
| A | 6.57 | 22.05 |

Sulfidation Resistance

Sulfidation resistance can be critical for hardware components exposed to certain chemical process streams, gas turbine combustion and exhaust streams, coat combustion and waste incineration environments. Scale penetration by sulfur can lead to nickel sulfide formation. This low melting point compound can cause rapid disintegration of nickel-containing alloys. It was discovered that alloys containing a minimum of about 0.015% (150 ppm) zirconium are unexpectedly extremely resistant to sulfidation as exemplified by the data of Table 9. Alloy A experiences rapid liquid phase degradation in $H_2$—45% $CO_2$—1% $H_2$ at 816° C. in approximately 30 hours. The remaining alloys showed gradual improvement as the zirconium content was raised but became dramatically resistant to sulfidation above about 0.015% (150 ppm) zirconium. Examination of the compositions tested suggest that yttrium plays a minor positive role in enhancing sulfidation resistance, but is unable to dramatically effect sulfidation resistance. Alloys containing more than 0.015 weight percent (150 ppm) zirconium have been tested in the above environment for nearly 1.5 years (12,288 hours) without failure.

TABLE 9

Effect of Zirconium Content on the Sulfidation Resistance of the Alloys of $H_2$ - 45% $CO_2$ - 1% $H_2$ at 816° C.

| Alloy | Zirconium Content (%) | Mass Change at 168 Hours (mg/cm$^2$) | Mass Change at Test Termination (Hours) | Mass Change at Test Termination (mg/cm$^2$) |
|---|---|---|---|---|
| 1 | 0.018 | 0.30 | 12,288 | 3.91 |
| 3 | 0.012 | 4.30 | 168 | 4.30 |
| 4 | 0.21 | 0.41 | 12,288 | 3.08 |
| 5 | 0.21 | 0.41 | 12,288 | 2.70 |
| 8 | 0.010 | 2.17 | 168 | 2.17 |
| 9 | 0.031 | 0.51 | 12,288 | 3.64 |
| A | None | 30.82 | 168 | 30.82 |

Nitridation Resistance

The zirconium-containing alloy also has outstanding resistance to nitridation as measured in pure ammonia at 1100° C. Data to 1056 hours are presented in Table 10. These data show that alloy B (low in aluminum) alloys containing 3 weight percent aluminum but no zirconium or yttrium (such as alloy C) and alloys containing only yttrium (such as alloy 13) possess good but not outstanding resistance to nitridation. Alloys 3 and 8, containing at least 2.75 weight percent aluminum and greater than 0.01 weight percent (100 ppm) each of zirconium and yttrium, possess outstanding resistance to nitridation.

TABLE 10

Effect of Zirconium and Yttrium on Nitridation Resistance in Pure Ammonia at 1100° C. Mass Change (mg/cm$^2$) Time in Hours

| Alloy | 240 | 312 | 504 | 552 | 720 | 768 | 1032 | 1056 |
|---|---|---|---|---|---|---|---|---|
| 3 | — | 0.47 | — | 0.55 | 0.62 | — | — | 0.68 |
| 8 | — | 0.48 | — | 0.55 | 0.63 | — | — | 0.70 |
| 13 | 6.17 | — | 9.91 | — | — | 11.58 | 12.75 | — |
| B | 4.42 | — | 7.33 | — | — | 8.70 | 10.03 | — |
| C | 6.02 | — | 9.76 | — | — | 11.46 | 12.68 | — |

This alloy range has maximum corrosion resistance to a broad range of aggressive high temperature environments. The alloy's properties are suitable for multiple high temperature corrosion applications, such as, regenerators, recuperators, combustors and other gas turbine components, muffles and furnace internals, retorts and other chemical process equipment and transfer piping, boiler tubing, piping and waterwall aprons and waste incineration hardware. Furthermore, a combination of γ', carbide precipitation and solid solution hardening provides a stable structure with the requisite strength for these high temperature corrosion applications.

In accordance with the provisions of the statute, the specification illustrates and describes specific embodiments of the invention. Those skilled in the art will understand that changes may be made in the form of the invention covered by the claims that certain features of the invention may sometimes be used to advantage without a corresponding use of the other features.

We claim:

1. A nickel-base alloy resistant to carburizing, oxidizing, nitriding and sulfidizing environments, consisting of, in weight percent, 42 to 58 nickel, 21.5 to 26 chromium, 12 to 18 cobalt, 4.5 to 9.5 molybdenum, 2 to 3.5 aluminum, 0.05 to 2 titanium, 0.005 to 0.1 yttrium 0.01 to 0.6 zirconium, 0.01 to 0.15 carbon, 0 to 0.01 boron, 0 to 4 iron, 0 to 0.4 manganese, 0 to 1 silicon, 0 to 1 hafnium, 0 to 0.4 niobium, 0.01 to 0.1 nitrogen, incidental impurities and deoxidizers.

2. The alloy of claim 1 including 43 to 57 nickel and 12.5 to 17.5 cobalt.

3. The alloy of claim 1 including 2.25 to 3.5 aluminum and 0.06 to 1.6 titanium.

4. The alloy of claim 1 including 0.01 to 0.5 zirconium, 0.01 to 0.14 carbon and 0.0001 to 0.01 boron.

5. A nickel-base alloy resistant to carburizing, oxidizing, nitriding and sulfidizing environments, consisting of, in weight percent, 43 to 57 nickel, 21.5 to 26 chromium, 12.5 to 17.5 cobalt, 4.5 to 9 molybdenum, 2.25 to 3.5 aluminum, 0.06 to 1.6 titanium, 0.01 to 0.08 yttrium, 0.01 to 0.5 zirconium, 0.01 to 0.14 carbon, 0.0001 to 0.01 boron, 0 to 3 iron, 0 to 0.4 manganese, 0.01 to 1 silicon, 0.01 to 0.8 hafnium, 0–0.4 niobium, 0.01 to 0.08 nitrogen, incidental impurities and deoxidizers.

6. The alloy of claim 5 including 44 to 56 nickel, 22 to 26 chromium, 13 to 17 cobalt and 5 to 8.5 molybdenum.

7. The alloy of claim 5 including 2.5 to 3.5 aluminum and 0.08 to 1.2 titanium.

8. The alloy of claim 5 including 0.02 to 0.5 zirconium, 0.01 to 0.12 carbon and 0.01 to 0.009 boron.

9. A nickel-base alloy resistant to carburizing, oxidizing, nitriding and sulfidizing environment, consisting of, in weight percent, 44 to 55 nickel, 22 to 26 chromium, 13 to 17 cobalt, 5 to 8.5 molybdenum, 2.5 to 3.5 aluminum, 0.08 to 1.2 titanium, 0.01 to 0.07 yttrium, 0.02 to 0.5 zirconium, 0.01 to 0.12 carbon, 0.001 to 0.009 boron, 0.1 to 2.5 iron, 0 to 0.4 manganese, 0.02 to 0.5 silicon, 0 to 0.7 hafnium, 0–0.004 niobium, 0.01 to 0.05 nitrogen, incidental impurities and deoxidizers.

10. The alloy of claim 9 including 45 to 55 nickel, 14 to 16 cobalt and 5 to 8 molybdenum.

11. The alloy of claim 9 including 2.75 to 3.5 aluminum and 0.1 to 1 titanium.

12. The alloy of claim 9 including 0.01 to 0.06 yttrium, 0.02 to 0.4 zirconium, 0.02 to 0.1 carbon and 0.003 to 0.008 boron.

13. The nickel base alloy of claim 9 containing 2.75 to 3.5 aluminum, 0.003 to 0.008 boron, 0.02 to 0.1 carbon, 14 to 16 cobalt, 22 to 26 chromium, 0.5 to 2 iron, 0 to 0.5 hafnium, 5 to 8 molybdenum, 0.01 to 0.05 nitrogen, 0 to 0.2 niobium, 45 to 55 nickel, 0.05 to 0.4 silicon, 0.1 to 1 titanium, 0.01 to 0.06 yttrium and 0.02 to 0.4 zirconium.

14. A nickel-base alloy resistant to carburizing, oxidizing environments consisting of, in weight percent, 45 to 55 nickel, 22 to 26 chromium, 14 to 16 cobalt, 5 to 8 molybdenum, 2.75 to 3.5 aluminum, 0.1 to 1 titanium, 0.01 to 0.06 yttrium, 0.01 to 0.4 zirconium, 0.02 to 0.1 carbon, 0.003 to 0.008 boron, 0.5 to 2 iron, 0 to 0.4 manganese, 0.05 to 0.4 silicon, 0 to 0.5 hafnium, 0 to 0.4 niobium, 0.01 to 0.05 nitrogen, incidental impurities and deoxidizers.

* * * * *